US007447473B2

(12) United States Patent
Jeong et al.

(10) Patent No.: US 7,447,473 B2
(45) Date of Patent: Nov. 4, 2008

(54) FIXING DEVICE WITH PRESSING MEMBER AND AN IMAGE FORMING APPARATUS HAVING THE SAME

(75) Inventors: Jae-hyeuk Jeong, Suwon-si (KR); Dong-jin Seol, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 175 days.

(21) Appl. No.: 11/411,041

(22) Filed: Apr. 26, 2006

(65) Prior Publication Data

US 2007/0071519 A1 Mar. 29, 2007

(30) Foreign Application Priority Data

Sep. 23, 2005 (KR) ..... 10-2005-0088934

(51) Int. Cl.
*G03G 15/20* (2006.01)

(52) U.S. Cl. ..... 399/329; 399/328; 399/330; 399/331; 399/335; 219/216

(58) Field of Classification Search ..... 399/320, 399/328–331, 335; 219/216
See application file for complete search history.

(56) References Cited

U.S. PATENT DOCUMENTS 5,614,999 A * 3/1997 Kanesawa et al. ..... 399/329
6,879,803 B2 * 4/2005 Gogate et al. ..... 399/329
2005/0123328 A1 6/2005 Aruga ..... 399/328

FOREIGN PATENT DOCUMENTS

| | | |
|---|---|---|
| JP | 2004-004920 | 1/2004 |
| JP | 2004-037764 | 2/2004 |
| KR | 1995-0006549 | 3/1995 |
| KR | 100209902 | 4/1999 |

* cited by examiner

*Primary Examiner*—David M. Gray
*Assistant Examiner*—Ryan D Walsh
(74) *Attorney, Agent, or Firm*—Roylance, Abrams, Berdo & Goodman L.L.P.

(57) ABSTRACT

A fixing device for fixing a toner image onto a recording medium, and an image forming apparatus having the same are provided. The fixing device includes a fixing roller heated by a heating source, and a pressing unit disposed opposite the fixing roller to bias a recording medium towards the fixing roller so that the recording medium contacts the fixing roller. The pressing unit has a movable support member, a pressing member mounted at the support member to face the fixing roller, a pressing belt rotatably disposed around the support member and the pressing member and biased by the pressing member to form a nip with the fixing roller, a driving roller for rotating the pressing belt, and a resilience applying member for biasing at least one of the support member and the driving roller toward the fixing roller. Accordingly, the pressing unit basically expands the width of the fixing nip to improve the image fixing capability.

20 Claims, 5 Drawing Sheets

FIXING DEVICE WITH PRESSING MEMBER AND AN IMAGE FORMING APPARATUS HAVING THE SAME

CROSS-REFERENCE TO RELATED APPLICATIONS

This application claims the benefit under 35 U.S.C. § 119 (a) of Korean Patent Application No. 2005-88934, filed Sep. 23, 2005, the entire contents of which are hereby incorporated by reference.

BACKGROUND OF THE INVENTION

1. Field of the Invention

The present invention relates to an electrophotographic image forming apparatus such as a laser printer, a multifunction apparatus, or a copier. More particularly, the present invention relates to a fixing device for fusing a toner image onto a recording medium, and an image forming apparatus having the same.

2. Description of the Related Art

In general, electrophotographic image forming apparatuses such as laser printers, multifunction apparatuses, or copiers, print out a desired image on a recording medium through a series of image formation processes including charging, laser exposure, developing, transferring, and fixing.

During the fixing process, a toner image transferred onto the recording medium is fixed by heat and pressure applied by a fixing device to permanently form the image. The fixing device typically comprises a fixing roller heated by a heating source, and a pressing roller for pressing the recording medium against the fixing roller.

FIG. 1 shows a conventional fixing device 1 in an electrophotographic image forming apparatus. The fixing device 1 includes a fixing roller 11 comprising a cylindrical metal core pipe 11*a* and a resilient layer 11*b* enclosing an outer surface of the core pipe 11*a*. The resilient layer 11*b* is coated with a non-cohesive layer 11*c*.

As shown in FIG. 2, a heating source, such as a halogen lamp 12, is mounted inside the fixing roller 11. The halogen lamp 12 generates heat in the fixing roller 11. Therefore, the fixing roller 11 is heated by radiant heat from the halogen lamp 12.

The pressing roller 13 is mounted at a lower part of the fixing roller 11. The pressing roller 13 comprises a cylindrical metal core pipe 13*a* and a resilient layer 13*b* enclosing an outer surface of the core pipe 13*a*. The resilient layer 13*b* is coated with a non-cohesive layer 13*c*.

The pressing roller 13 is resiliently supported by a spring device 17, thereby biasing a recording medium 14, such as paper, passing through a fixing nip between the fixing roller 11 and the pressing roller 13 with a predetermined pressure.

Accordingly, while passing through the nip between the fixing roller 11 and the pressing roller 13, a toner image 14*a* transferred on the recording medium 14 is heated and pressed. As a result, the toner image 14*a* is fused on the recording medium 14 by the heat and pressure applied by the fixing roller 11 and the pressing roller 13.

In the conventional fixing device 1, however, the fixing roller 11 and the pressing roller 13 form the fixing nip by contacting each other. Therefore, when the rotational speeds of the fixing roller 11 and the pressing roller 13 are increased for high-speed printing, the time that the recording medium 14 bearing the toner image 14*a* stays at the fixing nip between the fixing roller 11 and the pressing roller 13 decreases. Therefore, the toner image 14*a* and the recording medium 14 may not be applied with the heat sufficiently or evenly. Accordingly, the incompletely fixed toner image 14*a* may cause deterioration of image quality.

To overcome the reduced time of the recording medium 14 at the fixing nip when performing high-speed printing, in the conventional fixing device 1, the outer diameters of the fixing roller 11 and the pressing roller 13 or the thicknesses of the resilient layers 11*b* and 13*b* have been increased.

When increasing the outer diameters of the fixing roller 11 and the pressing roller 13, however, the volume of the image forming apparatus increases. Furthermore, as the size of the fixing roller 11 increases, the heat capacity and/or warm-up time for heating the fixing roller 11 should be increased. This produces an increase in manufacturing costs, and an increase in power consumption.

When increasing the thickness of the resilient layers 11*b* and 13*b*, on the other hand, the warm-up time for heating the fixing roller 11 needs to be increased. Also, the heating temperature for the fixing roller 11 should be increased to maintain the fixing temperature of the resilient layers 11*b* and 13*b*. Accordingly, power consumption increases. Furthermore, when increasing the heating temperature for the fixing roller 11, the lifespan of the fixing roller 11 and the pressing roller 13 may be shortened due to deterioration of the resilient layers 11*b* and 13*b*, and/or deterioration of the contacting portion between the resilient layers 11*b* and 13*b* and the metal core pipes 11*a* and 13*a*.

In addition, to prevent deterioration of fixing performance, the pressure of the pressing roller 13 applied to the fixing roller 11 has been increased by strengthening the resilience of the spring device 17 in the conventional fixing device 1.

However, when the pressure of the pressing roller 13 is increased, the resilient layers 11*b* and 13*b* of the fixing roller 11 and the pressing roller 13 may be deformed or distorted. Therefore, the heat and pressure of the fixing roller 11 and the pressing roller 13 may be applied unevenly to the toner image 14*a* and the recording medium 14, thereby causing deterioration of image quality. Furthermore, when the recording medium 14 cannot move smoothly due to excessive pressure, paper jams frequently occur. In addition, because the driving torque for driving the fixing roller 11 is increased, a driving motor for driving the fixing roller 11 may be damaged by the increased load.

Consequently, there is a need for an improved fixing device, which is capable of guaranteeing stable image quality when performing high-speed printing without having to increasing the outer diameters of the fixing roller 11 and the pressing roller 13 or thickness of the resilient layers 11*b* and 13*b* or increasing the pressure of the pressing roller 13.

SUMMARY OF THE INVENTION

An aspect of the present invention is to address at least the above problems and/or disadvantages and to provide at least the advantages described below. Accordingly, an aspect of the present invention is to provide a fixing device capable of preventing problems caused by high-speed printing in a conventional fixing device, by basically increasing the width of a fixing nip with respect to a recording medium feeding direction, and an image forming apparatus having the same.

In accordance with an aspect of the present invention, a fixing device of an image forming apparatus comprises a fixing roller heated by a heating source, and a pressing unit disposed opposite to the fixing roller to bias a recording medium having a toner image to the fixing roller so that the recording medium contacts the fixing roller. The pressing unit comprises a movable support member, a pressing member disposed on the support member to face the fixing roller, a pressing belt rotatably disposed around the support member and the pressing member, the pressing belt being biased by the pressing member to form a nip with the fixing roller, a driving roller for rotating the pressing belt, and a resilience applying member for biasing at least one of the support member and the driving roller toward the fixing roller.

The pressing member may comprise first and second pin rollers rotatably disposed on the support member for biasing the pressing belt toward the fixing roller, and a surface-contact portion disposed on the support member between the first and second pin rollers for biasing the pressing belt toward the fixing roller.

The first and second pin rollers may comprise a cylindrical body comprising a metal having high stiffness and high thermal-conductivity.

The first and second pin rollers may have a radius not greater than 10 mm.

The surface-contact portion may comprise a concave board having a resilient layer on a side facing the fixing roller.

A surface of the resilient layer contacting the pressing belt may be coated with a lubricant.

When the support member is not resiliently biased toward the fixing roller by the resilience applying member, the concave board may protrude toward the fixing roller beyond an imaginary circumferential surface track. The imaginary circumferential surface track connects two lines on the first and second pin rollers and is concentric with the fixing roller.

A resilient spring may be mounted to the support member for resiliently supporting the concave board.

The support member may comprises a support body comprising an upper concave surface for accommodating the surface-contact portion of the pressing member and a lower concave surface for accommodating the driving roller, and first and second pin roller support parts for accommodating the first and second pin rollers.

The first and second pin roller support parts may comprise an outer surface for contacting the pressing belt, the outer surfaces being coated with a lubricant.

The pressing belt may comprise an under layer formed of one of a high molecular substance or metal, a resilient layer formed on the under layer, and a non-cohesive layer formed on the resilient layer.

In accordance with another aspect of the present invention, an image forming apparatus comprises a main body comprising a fixing unit frame, and a fixing device comprising a fixing roller rotatably mounted to the fixing unit frame and heated by a heating source, and a pressing unit corresponding to the fixing roller for biasing a recording medium having a toner image towards the fixing roller so that the recording medium contacts with the fixing roller. The pressing unit comprises a movable support member, a pressing member disposed on the support member to face the fixing roller, a rotatable pressing belt disposed around the support member and the pressing member, the pressing member biasing the pressing belt so that the pressing belt forms a nip with the fixing roller, a driving roller for rotating the pressing belt, and a resilience applying member for biasing at least one of the support member and the driving roller toward the fixing roller.

The pressing member may comprise first and second pin rollers rotatably disposed on the support member for biasing the pressing belt toward the fixing roller, and a surface-contact portion disposed on the support member between the first and second pin rollers for biasing the pressing belt toward the fixing roller.

The first and second pin rollers may comprise a cylindrical body comprising a metal having high stiffness and high thermal-conductivity.

The first and second pin rollers respectively may have a radius not greater than 10 mm.

The surface-contact portion may comprise a concave board having a resilient layer on a side facing the fixing roller.

When the support member is not resiliently biased toward the fixing roller by the resilience applying member, the concave board may protrude toward the fixing roller beyond an imaginary circumferential surface track. The imaginary circumferential surface track connects two lines on the first and second pin rollers and is concentric with the fixing roller.

A resilient spring may be mounted to the support member for resiliently supporting the concave board.

The support member may comprise a support body comprising an upper concave surface for accommodating the surface-contact portion of the pressing member and a lower concave surface for accommodating the driving roller, and first and second pin roller support parts for accommodating the first and second pin rollers.

The pressing belt may comprise an under layer formed of one of a high molecular substance or a metal, a resilient layer formed on the under layer, and a non-cohesive layer formed on the resilient layer.

BRIEF DESCRIPTION OF THE DRAWING FIGURES

The above and other objects, features, and advantages of certain exemplary embodiments of the present invention will be more apparent from the following description taken in conjunction with the accompanying drawings, in which.

Throughout the drawings, the same reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
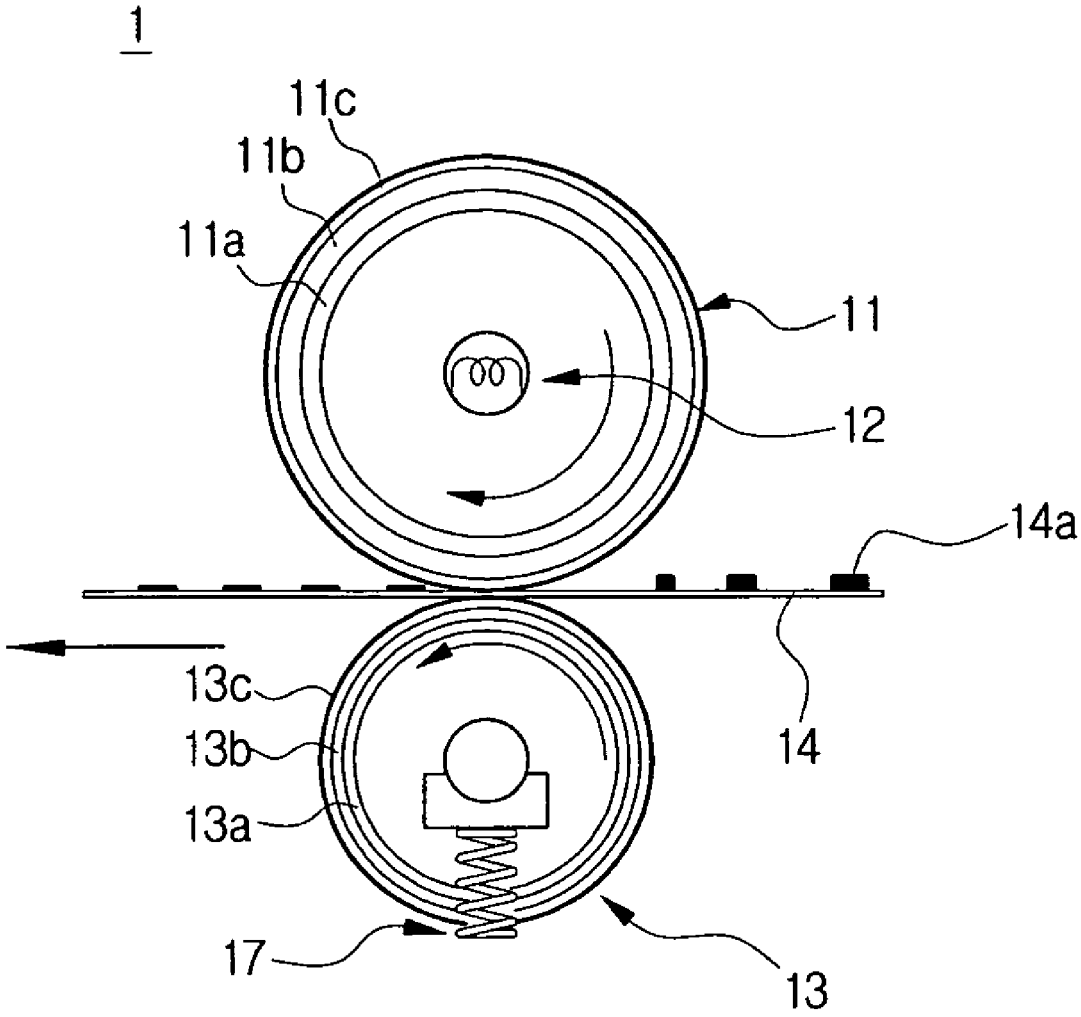
FIG. 1 (PRIOR ART)
FIG. 1 is a side view of a conventional fixing device applied to an electrophotographic image forming apparatus.
Figure 2:
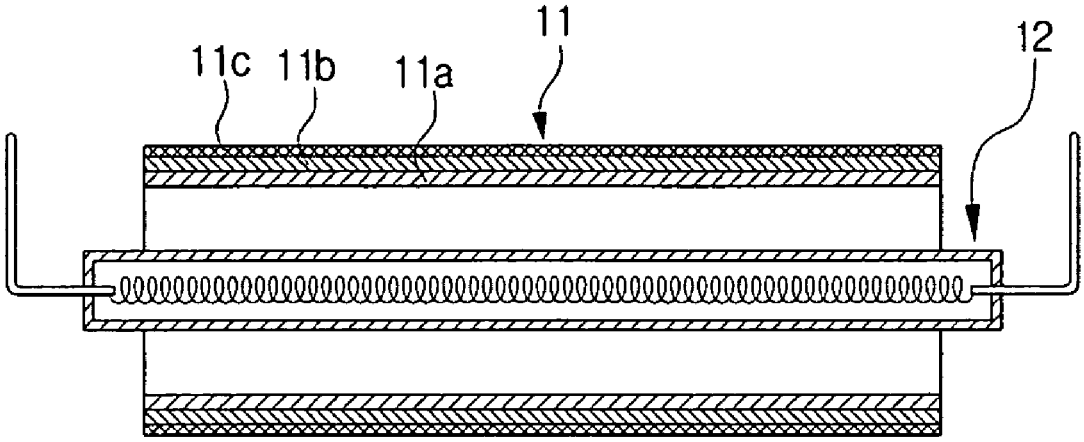
FIG. 2 (PRIOR ART)
FIG. 2 is a front sectional view of a fixing roller used in the fixing device of FIG. 1.
Figure 3:
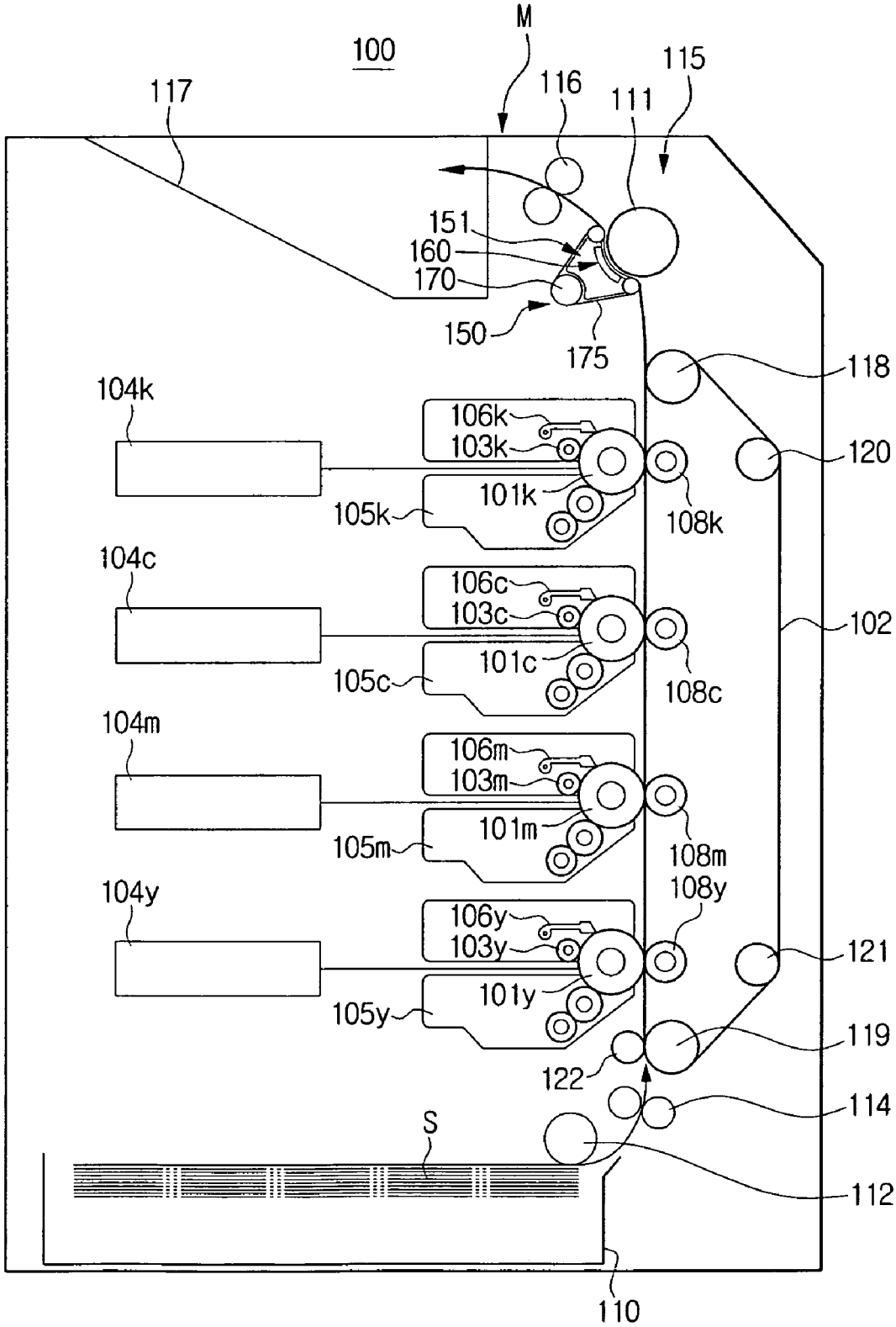
FIG. 3 is a schematic view of a tandem-type color image forming apparatus applying a fixing device according to an exemplary embodiment of the present invention.

FIG. 3 schematically shows an image forming apparatus comprising a fixing device according to an exemplary embodiment of the present invention.

According to an exemplary embodiment of the present invention, the image forming apparatus comprises a tandem-type color laser printer 100 that prints out data input from an external apparatus such as a personal computer.

As shown in FIG. 3, the tandem-type color laser printer 100 includes a paper supply cassette 110. The paper supply cassette 110 is mounted at a lower part of a main body M of the image forming apparatus. A recording medium S such as paper is stacked in the paper supply cassette 110 to be picked up by a pickup roller 112 and fed to a registration roller 114.

Down stream of the register roller 114, a transfer belt 102 for feeding the recording medium is mounted by a plurality of rollers including a driving roller 118, a driven roller 119, and first and second tension rollers 120 and 121 along a recording medium feeding direction (vertical direction in FIG. 3). A pressing roller 122 is disposed to press the transfer belt 102 toward the driven roller 119.

The pressing roller 122 is applied with a predetermined bias voltage and therefore, the recording medium S being fed by the register roller 114 to the transfer belt 102 is attached and fed to the transfer belt 102.

Four photoconductive mediums 101*y*, 10*m*, 101*c* and 101*k* for predetermined colors such as yellow, magenta, cyan and black are vertically arranged along the transfer belt 102 from a lower part to an upper part (with respect to FIG. 3).

Charge units 103*y*, 103*m*, 103*c* and 103*k*, laser scanning units 104*y*, 104*m*, 104*c* and 104*k*, developing units 105*y*, 105*m*, 105*c* and 105*k*, and cleaning blades 106*y*, 106*m*, 106*c* and 106*k* are mounted around the photoconductive mediums 101*y*, 101*m*, 101*c* and 101*k*, respectively. Transfer rollers 108*y*, 108*m*, 108*c* and 108*k* are arranged inside the transfer belt 102.

Toner of the respective colors is stored in toner receptacles of the developing units 105*y*, 105*m*, 105*c* and 105*k*. Toner images of the respective colors are formed on the photoconductive mediums 101*y*, 101*m*, 101*c* and 101*k* through a series of image formation processes and are transferred onto the recording medium S by the transfer belt 102 in sequence so that they overlap one another. Accordingly, a color toner image is formed.

The recording medium S whereon the color toner image is formed is fed to a fixing device 115. The toner image is fixed by the fixing device 115.

The fixing device 115 comprises a fixing roller 111 and a pressing unit 150.

Figure 4:
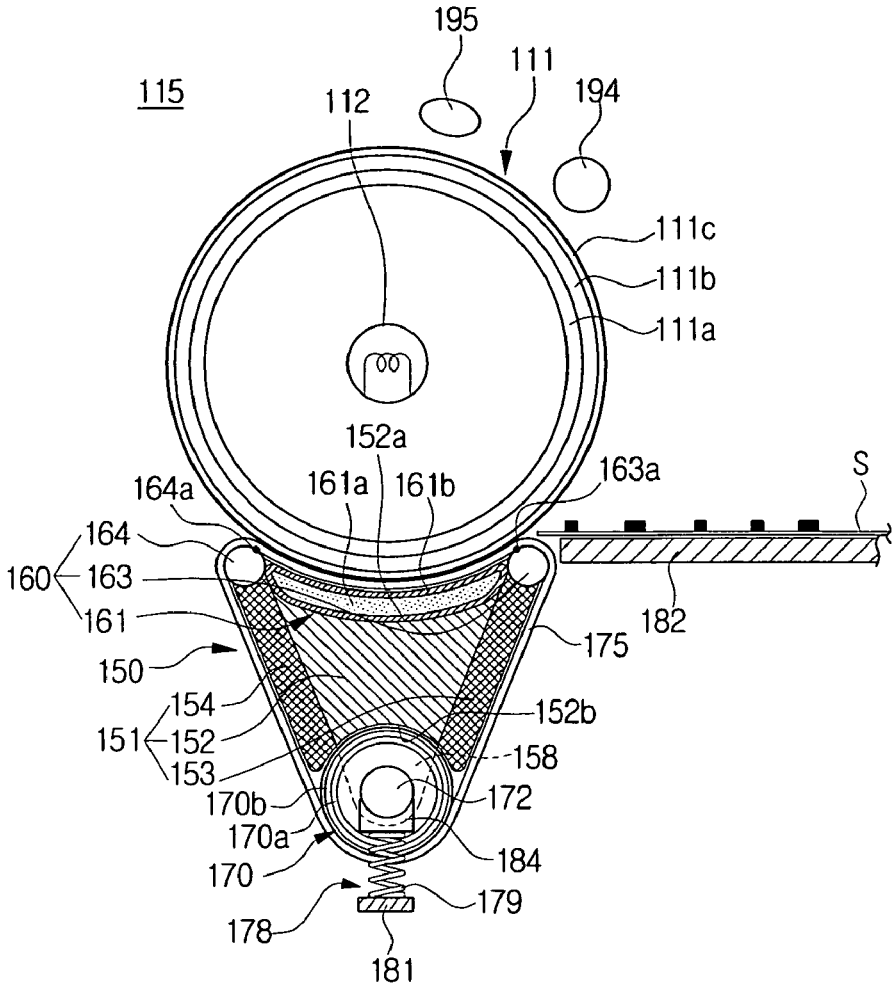
FIG. 4 is a side sectional view of a fixing device for the image forming apparatus of FIG. 3.

As shown in FIG. 4, the fixing roller 111 comprises a cylindrical core pipe 111*a* and a resilient layer 111*b* enclosing an outer surface of the core pipe 111*a*. The resilient layer 111*b* may be formed of, for example, silicon rubber, urethane or foamed resin. The core pipe 111*a* may be formed of, for example, aluminum alloy or stainless steel.

For superior non-cohesive property with respect to the toner image, the resilient layer 111*b* is coated with a non-cohesive layer 111*c* which may be formed of, for example, polytetrafluoroethylene (PTFE).

A halogen lamp 112 as a heating source is mounted at the inner center of the fixing roller 111. The halogen lamp 112 generates heat in the fixing roller 111. Therefore, the fixing roller 11 is heated by radiant heat from the halogen lamp 112.

First and second flanges (not shown) are formed at both ends of the fixing roller 111 to seal the core pipe 111*a*. The first and second flanges are equipped with a fixing roller shaft (not shown), respectively. One of the fixing roller shafts is equipped with a fixing roller gear (not shown).

The fixing roller gear is driven in connection with a power transmission gear train (not shown) connected to a driving motor (not shown) for driving the pickup roller 111 and the driving roller 118 mounted in the main body M. Since the principle and structure of the fixing roller gear and the power transmission gear train is generally known, a detailed description is omitted for conciseness.

The pressing unit 150 biases the recording medium S toward the fixing roller 111 so that the surface of the recording medium S contacts the fixing roller 111. Therefore, the pressing unit 150 is disposed to face the fixing roller 111.

The pressing unit 150 comprises a support member 151, a pressing member 160, a pressing belt 175, a driving roller 170, and a resilience applying member 178.

The support member 151 is formed along the lengthwise direction of the fixing roller 111 and the support member has a substantially trapezium cross-sectional shape. In addition, the support member 151 is mounted to a fixing unit frame (not shown) of the main body M to be resiliently moved by the resilience applying member 178 in a vertical direction in FIG. 4.

The support member 151 comprises a support body 152 having a substantially trapezium cross-sectional shape, and first and second pin roller support parts 153 and 154 formed as a long plate.

The support body 152 comprises an upper concave surface 152*a* at an upper part thereof to mount a surface-contact portion 161 of the pressing member 160, and a lower concave surface 152*b* at a lower part thereof to mount the driving roller 170.

Figure 5:
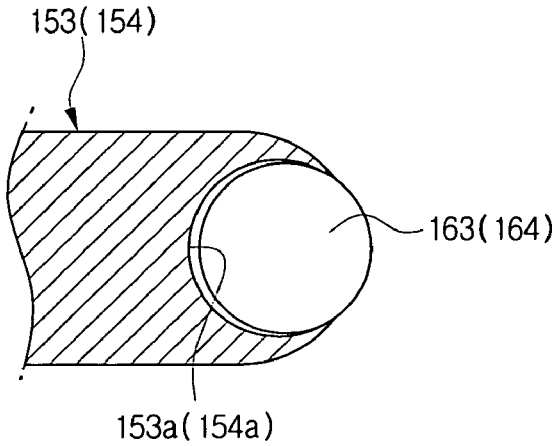
FIG. 5 is a partial side-sectional view illustrating a mounting structure of a pin roller of a pressing member of the fixing device of FIG. 4.

The first and second pin roller support parts 153 and 154 are integrally formed with the support body 152 at its upstream and downstream ends (with respect to the recording medium feeding direction), respectively. As shown in FIG. 5, first and second arc support grooves 153*a* and 154*a* are formed respectively at upper parts of the first and second pin roller support parts 153 and 154 so as to receive and support first and second pin rollers 163 and 164 that will be described later.

As well as supporting the first and second pin rollers 163 and 164, the first and second pin roller support parts 153 and 154 contact and guide movement of the pressing belt 175. For smooth running of the pressing belt 175, the outer surfaces of the first and second pin roller support parts 153 and 154 may be coated with a lubricant, such as an oil or grease layer.

In the illustrated, exemplary embodiment, the first and second pin roller support parts 153 and 154 are integrally formed with the support body 152. The first and second pin roller support parts 153 and 154 may be separately formed from the support body 152 for more facile formation of the first and second arc support grooves 153*a* and 154*a* and then fixed to the support body 152 through a fixing means such as an adhesive or a screw.

The support body 152 of the support member 151 and the first and second pin roller support parts 153 and 154 are formed of, for example, a heat-resistant compound material such as fiber reinforced plastic (FRP) and plastic-family compound, or a stiff material such as a ceramic.

The pressing member 160 is disposed at an upper part of the support member 151 facing the fixing roller 111. In other words, the pressing member 160 is disposed at upper parts of the first and second pin roller support parts 153 and 154 and the support body 152. The pressing member 160 biases the pressing belt 175 toward the fixing roller 111 to form a fixing nip, which is a contacting surface between the pressing belt 175 and the fixing roller 111.

The pressing member 160 comprises the first and second pin rollers 163 and 164, and the surface-contact portion 161.

The first and second pin rollers 163 and 164 are rotatably mounted to the first and second arc support grooves 153*a* and 154*a* of the first and second pin roller support parts 153 and 154.

The first and second pin rollers 163 and 164 bias the pressing belt 175 toward the fixing roller 111 with a predetermined pressure, at upstream and downstream ends of the fixing nip formed between the fixing roller 111 and the pressing belt 175, thereby forming a nip between the pressing belt 175 and the fixing roller 111. The first and second pin rollers form a line-contact nip, or nip that is formed in a line substantially along the length of the rollers.

The first and second pin rollers 163 and 164 may comprise a material of high stiffness and high thermal-conductivity, such as general carbon steel, stainless steel, aluminum or aluminum alloy. Further, the first and second pin rollers 163 and 164 are preferably formed as a cylindrical body having a radius not greater than 10 mm, to minimize heat absorption by the rollers.

The surface-contact portion 161 comprises a concave board 161*a* mounted along a lengthwise direction at the upper concave surface 152*a* of the support body 152. The concave board 161*a* is fixed to the upper concave surface 152*a* through a fixing means such as an adhesive or a screw.

In the same aspect as the support member 151, the concave board 161*a* is formed of, for example, a heat-resistant compound material such as a fiber reinforced plastic (FRP) and plastic-family compound, or a stiff material such as a ceramic.

The surface of the concave board 161*a* is formed with a resilient layer 161*b* having a predetermined thickness and formed of, for example, silicon, rubber, urethane or foamed resin.

Alternatively, a resilient layer (not shown) may be formed only on an upper surface of the concave board 161*a* facing the fixing roller 111, instead of on the whole surface.

In addition, for smooth rotation of the pressing belt 175, an upper surface of the resilient layer 161*b* that contacts the pressing belt 175 may be coated with a lubricant, such as an oil or grease layer.

When the support member 151 is not resiliently biased toward the fixing roller 111 by the resilience applying member 178, the concave board 161*a* protrudes a small amount toward the fixing roller 111 beyond an imaginary circumferential surface track connecting two lines 163*a* and 164*a* on the first and second pin rollers 163 and 164 and concentric with the fixing roller 111. The circumferential surface track, in other words, refers to an inner surface of the pressing belt 175 that contacts the fixing roller 111 when the support member 152 is resiliently biased toward the fixing roller 111 by the resilience applying member 178. Therefore, when the support member 151 is resiliently biased toward the fixing roller 111 by the resilience applying member 178, the concave board 161*a* is able to bias the pressing belt 175 toward the fixing roller 111 with a predetermined pressure between the first and second pin rollers 163 and 164. Accordingly, a nip is formed between the pressing belt 175 and the fixing roller 111. The concave board 161 a forms a surface-contact nip, or nip that is formed along the surface of the board.

Figure 6:
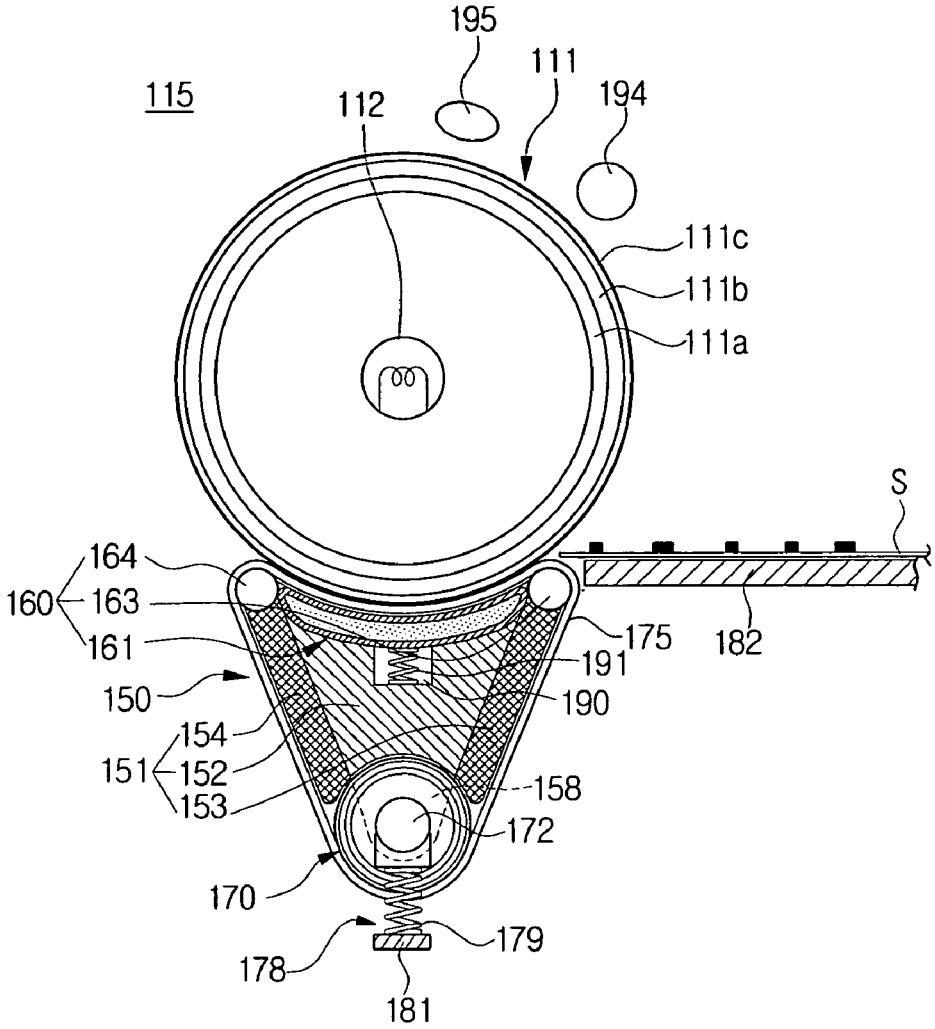
FIG. 6 is a partial side-sectional view illustrating another mounting structure of a surface-contact part of the pressing member of the fixing device of FIG. 3.

Alternatively, instead of protruding beyond the above circumferential surface track, the concave board 161*a* may be supported by first and second support springs 191, only one of which is shown, mounted at first and second receiving recesses 190, only one of which is shown, at the opposite ends of the fixing roller, as shown in FIG. 6.

The pressing belt 175 is disposed to be rotatable by the driving roller 170 along outer surfaces of the first and second pin roller support parts 153 and 154, and the upper surfaces of the first and second pin rollers 163 and 164 and the concave board 161*a*. Additionally, the first and second pin rollers 163 and 164 and the concave board 161*a* bias the pressing belt 175 into contact with the fixing roller 111 to form a fixing nip.

Figure 7:
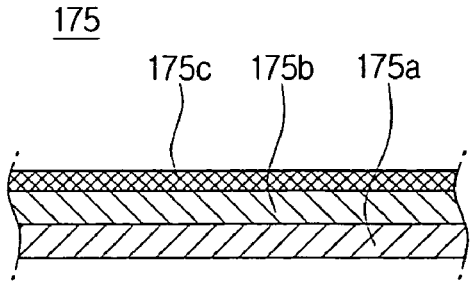
FIG. 7 is a sectional view of a pressing belt of the fixing device of FIG. 4.

As shown in FIG. 7, the pressing belt 175 comprises an under layer 175*a*, a resilient layer 175*b*, and a non-cohesive layer 175*c*. The under layer is formed of, for example, a high molecular substance such as polyimide (PI) or polyether Etherketone (PEEK), or a metal such as nickel, nickel alloy, stainless steel, aluminum, aluminum alloy, copper and copper alloy. The resilient layer 175*b* is formed on the under layer 175*a* and is formed of, for example, silicon rubber, urethane or foamed resin. The non-cohesive layer 175*c* is formed on the resilient layer 175*b* and formed of, for example, polytetrafluoroethylene (PTFE).

The driving roller 170 is provided to rotate the pressing belt 175. Both ends of a driving roller shaft 172 are rotatably supported by first and second shaft support parts 158, only one of which is shown, which protrude downward from the both ends of the support body 152 with respect to the lengthwise direction.

The driving roller 170 comprises a cylindrical core pipe 170*a* and a resilient layer 170*b* enclosing an outer surface of the core pipe 170*a*. The resilient layer 170*b* may be formed of, for example, silicon rubber, urethane, or foamed resin. The core pipe 170*a* may be formed of, for example, aluminum alloy or stainless steel.

Alternatively, for the purpose of rotating the pressing belt 175, the driving roller 170 may comprise only a cylindrical core pipe (not shown) without a resilient layer on its outer surface.

A driving roller gear (not shown) is mounted at one end of the driving roller shaft 172. The driving roller gear may be driven by the power transmission gear train connected to the driving motor that drives the pickup roller 111 and the driving roller 118 mounted in the main body M, or by a dedicated power transmission gear train (not shown) connected to the fixing roller gear.

The resilience applying members 178 are mounted at both ends of the driving roller shaft 172, respectively, through the first and second shaft support parts 158 to resiliently bias the support member 151 fixing the driving roller 170 toward the fixing roller 111.

The resilient applying member 178 comprises first and second compression springs 179 (only one of which is shown) disposed between first and third spring support parts and between second and fourth spring support parts, respectively. The first and second spring support parts 181 (only one of which is shown) are formed at the fixing unit frame, and the third and the fourth spring support parts 184 (only one of which is shown) are formed at both ends of the driving roller shaft 172.

In this exemplary embodiment, the driving roller 170 is supported through the driving roller shaft 172 which is supported by the support member 151 through the first and second shaft support parts 158. However, the driving roller 170 may be supported by first and second shaft support parts (not shown) formed on the fixing unit frame of the main body M. In this case, the resilience applying member 178 comprises first and second compression springs (not shown) disposed respectively between first and third spring support parts and between second and fourth spring support parts, the first and second spring support parts (not shown) formed at the fixing unit frame and the third and the fourth spring support parts (not shown) formed at the both ends of the support body 152.

As shown in FIG. 4, the fixing device 115 may further comprise a thermistor 194 for detecting the surface temperature of the fixing roller 111 as an electric signal, and a thermostat 195 for shutting off power to the halogen lamp 112 when the surface temperature of the fixing roller 111 exceeds a threshold value.

The thermistor 194 is mounted near the surface of the fixing roller 111 without contacting the surface of the fixing roller. Alternatively, the thermistor 194 may contact the surface of the fixing roller 111.

The thermistor 194 detects the surface temperature of the fixing roller 111 and transmits the detected result to a control unit (not shown). The control unit controls the power supplied to the halogen 112 according to the detected temperature, thereby maintaining the surface temperature of the fixing roller 111 within a certain range.

The thermostat 195 is mounted near the surface of the fixing roller 111 without contacting the surface of the fixing roller 111. Alternatively, the thermostat 195 may contact the surface of the fixing roller 111.

The thermostat 195 protects components in the vicinity of the fixing roller 111 by preventing the components from being overheated if the thermistor 194 and the control unit fail to control the temperature of the fixing roller 111.

Although the thermistor 194 and the thermostat 195 are mounted so that they either contact or do not contact the surface of the fixing roller 111 in this exemplary embodiment, they may also be installed (with or without contact) in fixing recesses (not shown) formed on the surface-contact portion 161 of the support member 160 inside the pressing belt 175.

Referring back to FIG. 3, the laser printer 100 comprises a discharge roller 116 disposed downstream of the fixing device 115. The discharge roller 116 discharges the recording medium S with the fixed toner image onto a discharged-paper tray 117 mounted at an upper part of the main body M.

As described above, the fixing device 115 according to an exemplary embodiment of the present invention comprises the pressing unit 150 that basically expands the width of the fixing nip with respect to the recording medium feeding direction. As a result, the length of time the recording medium S stays at the fixing nip can be increased, compared to the conventional fixing devices wherein the outer diameters of the fixing roller 11 and the pressing roller 13 or thickness of the resilient layers 11*b* and 13*b* are increased, or when the pressure of the pressing roller 13 is increased in order to enhance fixing performance when performing high-speed printing. Therefore, the recording medium S can stay at the fixing nip long enough for image fixation even during high-speed printing. Accordingly, fixing quality is improved. In addition, since the fixing temperature of the fixing roller 111 or the pressure by the resilience applying member 178 can be decreased as compared to a conventional fixing device, warm-up time and the subsequent power consumption can be reduced. Also, deterioration of the resilient layers 111*b* and the contacting portion between the resilient layer 111*b* and the metal core pipe 111*a* can be restrained, thereby improving lifespan of the fixing roller 111.

Moreover, since the pressing unit 150 of the fixing device 115 according to an exemplary embodiment of the present invention comprises the pressing belt 175 and the pressing member 160 having a relatively simple structure, manufacturing costs can be reduced.

In the above description, the fixing device 115 was described in connection with a tandem-type color laser printer 100. The present invention, however, is not limited to that particular type of printer, and the fixing device 115 can be used with other types of image forming apparatuses such as copiers and facsimile machines.

With reference to FIG. 3, the operation of the tandem-type color laser printer 100 employing the fixing device 115 according to an exemplary embodiment of the present invention will now be described.

When a printing command is input through a computer or a control panel (not shown), the recording medium S stacked in the paper supply cassette 110 is picked up by a pickup roller 112 and fed to the register roller 114.

As the recording medium S is passed through the register roller 114, it arrives at the transfer belt 102, and the recording medium S is attached and fed to the transfer belt 102 rotated by the driving roller 170 by the bias voltage applied by the pressing roller 122.

While the recording medium S is being fed to the transfer belt 102, color toner images are formed according to image data on the surfaces of the respective photoconductive mediums 101*y*, 101*m*, 101*c* and 101*k* through image formation processes performed by the charge units 103*y*, 103*m*, 103*c* and 103*k*, laser scanning units 104*y*, 104*m*, 104*c* and 104*k*, and developing units 105*y*, 105*m*, 105*c* and 105*k*.

As the recording medium S being fed by the transfer belt 102 passes through transfer nips formed respectively between the photoconductive mediums 101*y*, 101*m*, 101*c* and 101*k* and the transfer rollers 108*y*, 108*m*, 108*c* and 108*k*, the toner images formed respectively on the photoconductive mediums 101*y*, 101*m*, 101*c* and 101*k* are transferred onto the recording medium S, which has a bias voltage applied from the transfer rollers 108*y*, 108*m*, 108*c* and 108*k*, so that the images overlap one another.

After the toner images are transferred, the recording medium S is fed to the fixing device 115.

When the recording medium S is advanced by a recording medium guide 182 toward the nip formed between the fixing roller 111 and the first pin roller 163, the recording medium S is passed through the nip formed between the fixing roller 111 and the surface-contact portion 161 and the nip formed between the fixing roller 111 and the second pin roller 164 by the pressing belt 175. Consequently, the toner image is fused as a permanent image on the recording medium S by pressure applied by the first pin roller 163, the surface-contact portion 161, and the second pin roller 164, and heat applied by the fixing roller 111.

Although heat is transferred from the fixing roller 111 to the recording medium S, the fixing temperature (in other words, the surface temperature of the fixing roller 111) of approximately 160~190° C. required for image fixation can be maintained by the halogen lamp 112 controlled by the thermistor 194 that detects the surface temperature of the fixing roller 111.

If the thermistor 194 and the control unit fail to control the fixing temperature and therefore, the surface temperature of the fixing roller 111 abruptly increases, the thermostat 195 cuts off the power supply for the halogen lamp 112 to prevent overheating of the fixing roller 111.

The recording medium S with the affixed toner image is discharged by the discharge roller 116 onto the discharged-paper tray 117 mounted at the upper part of the main body M.

As can be appreciated from the above description, the fixing device and the image forming apparatus comprising the same according to an exemplary embodiment of the present invention comprises a pressing unit that basically expands width of the fixing nip with respect to the recording medium feeding direction. As a result, the time that the recording medium stays at the fixing nip can be increased, compared to conventional fixing devices where the outer diameters of the fixing roller and the pressing roller or thicknesses of the resilient layers are increased, or pressure of the pressing roller is increased in order to enhance fixing performance when performing high-speed printing. Therefore, the recording medium can stay at the fixing nip long enough for image fixation even during high-speed printing. Accordingly, fixing quality is improved. In addition, since the fixing temperature of the fixing roller or the pressure applied by the resilience applying member can be decreased compared to a conventional fixing device, warm-up time and subsequent power consumption can be reduced. Also, deterioration of the resilient layers and the contacting portion between the resilient layer and the metal core pipe can be restrained, thereby improving the lifespan of the fixing roller.

Moreover, in the fixing device and the image forming apparatus comprising the same, since the pressing unit comprises a pressing belt and a pressing member having a relatively simple structure, manufacturing costs can be reduced.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A fixing device of an image forming apparatus, comprising:

a fixing roller heated by a heating source; and a pressing unit disposed opposite to the fixing roller for biasing a recording medium having a toner image thereon towards the fixing roller so that the recording medium contacts the fixing roller, the pressing unit comprising:

a movable support member;

a pressing member disposed on the support member to face the fixing roller;

a pressing belt rotatably disposed around the support member and the pressing member, the pressing member biasing the pressing belt toward the fixing roller so that the pressing belt forms a nip with the fixing roller;

a driving roller for rotating the pressing belt; and a resilience applying member for biasing at least one of the support member and the driving roller toward the fixing roller;

wherein the pressing member comprises first and second pin rollers rotatably disposed on the support member for biasing the pressing belt toward the fixing roller.

2. The fixing device of claim 1, wherein the pressing member further comprises a surface-contact portion disposed on the support member between the first and second pin rollers for biasing the pressing belt toward the fixing roller.

3. The fixing device of claim 2, wherein the surface-contact portion comprises a concave board having at least one resilient layer on a side facing the fixing roller.

4. The fixing device of claim 3, wherein a surface of the resilient layer contacting the pressing belt comprises a lubricant.

5. The fixing device of claim 3, wherein when the support member is not resiliently biased toward the fixing roller by the resilience applying member, the concave board protrudes toward the fixing roller beyond an imaginary circumferential surface track, the imaginary circumferential surface track connecting two lines on the first and second pin rollers and being concentric with the fixing roller.

6. The fixing device of claim 3, further comprising a resilient spring mounted to the support member for resiliently supporting the concave board.

7. The fixing device of claim 2, wherein the support member comprises:

a support body comprising an upper concave surface for accommodating the surface-contact portion of the pressing member and a lower concave surface for accommodating the driving roller; and first and second pin roller support parts for accommodating the first and second pin rollers.

8. The fixing device of claim 7, wherein the first and second pin roller support parts respectively comprise an outer surface for contacting the pressing belt, the outer surfaces comprising a lubricant.

9. The fixing device of claim 1, wherein the first and second pin rollers comprise a cylindrical body comprising a metal having high stiffness and high thermal-conductivity.

10. The fixing device of claim 9, wherein the first and second pin rollers respectively have a radius not greater than 10 mm.

11. The fixing device of claim 1, wherein the pressing belt comprises:

an under layer formed of at least one of a high molecular substance and a metal;

a resilient layer formed on the under layer; and a non-cohesive layer formed on the resilient layer.

12. An image forming apparatus comprising:

a main body comprising a fixing unit frame; and a fixing device comprising a fixing roller rotatably mounted to the fixing unit frame and heated by a heating source, and a pressing unit corresponding to the fixing roller for biasing a recording medium having a toner image towards the fixing roller so that the recording medium contacts with the fixing roller, wherein the pressing unit comprises:

a movable support member movably mounted;

a pressing member disposed on the support member to face the fixing roller;

a rotatable pressing belt disposed around the support member and the pressing member, the pressing member biasing the pressing belt so that the pressing belt forms a nip with the fixing roller;

a driving roller for rotating the pressing belt; and a resilience applying member for biasing at least one of the support member and the driving roller toward the fixing roller; and wherein the pressing member comprises first and second pin rollers rotatably disposed on the support member for biasing the pressing belt toward the fixing roller.

13. The image forming apparatus of claim 12, wherein the pressing member further comprises a surface-contact portion disposed on the support member between the first and second pin rollers for biasing the pressing belt toward the fixing roller.

14. The image forming apparatus of claim 13, wherein the surface-contact portion comprises a concave board having a resilient layer on a side facing the fixing roller.

15. The image forming apparatus of claim 14, wherein when the support member is not resiliently biased toward the fixing roller by the resilience applying member, the concave board protrudes toward the fixing roller beyond an imaginary circumferential surface track, the imaginary circumferential surface track connecting two lines on the first and second pin rollers and being concentric with the fixing roller.

16. The image forming apparatus of claim 14, further comprising a resilient spring mounted to the support member for resiliently supporting the concave board.

17. The image forming apparatus of claim 12, wherein the first and second pin rollers comprise a cylindrical body comprising a metal having high stiffness and high thermal-conductivity.

18. The image forming apparatus of claim 17, wherein the first and second pin rollers respectively have a radius not greater than 10 mm.

19. The image forming apparatus of claim 17, wherein the support member comprises:

a support body comprising an upper concave surface for accommodating the surface-contact portion of the pressing member and a lower concave surface for accommodating the driving roller; and first and second pin roller support parts for accommodating the first and second pin rollers.

20. The image forming apparatus of claim 12, wherein the pressing belt comprises:

an under layer formed of at least one of a high molecular substance and a metal;

a resilient layer formed on the under layer; and a non-cohesive layer formed on the resilient layer.

* * * * *